US005743231A

United States Patent [19]

Reinosa

[11] Patent Number: 5,743,231

[45] Date of Patent: Apr. 28, 1998

[54] AUTOMATIC METHOD AND APPARATUS FOR PREVENTING WEAR IN AN INTERNAL COMBUSTION ENGINE

[76] Inventor: Adan Reinosa, 1729 Westmoreland Dr., Montebello, Calif. 90640

[21] Appl. No.: 807,022

[22] Filed: Feb. 26, 1997

Related U.S. Application Data

[60] Provisional application No. 60/012,613 Mar. 1, 1996.

[51] Int. Cl. [6] ..... F01M 5/02

[52] U.S. Cl. ..... 123/196 S; 184/6.4

[58] Field of Search ..... 123/196 S; 184/6.3, 184/6.4

[56] References Cited

U.S. PATENT DOCUMENTS

| | | | |
|---|---|---|---|
| 4,936,272 | 6/1990 | Whitmore | 123/196 S |
| 5,000,143 | 3/1991 | Brown | 123/196 S |
| 5,121,720 | 6/1992 | Roberts | 123/196 S |
| 5,195,476 | 3/1993 | Schwarz | 123/196 S |
| 5,197,424 | 3/1993 | Blum | 123/196 S |
| 5,236,064 | 8/1993 | Wagoner | 123/196 S |
| 5,263,445 | 11/1993 | Bedi et al. | 123/196 S |
| 5,372,219 | 12/1994 | Peralta | 123/196 S |
| 5,390,762 | 2/1995 | Nelson | 123/196 S |
| 5,494,012 | 2/1996 | Hagen | 123/196 S |
| 5,511,522 | 4/1996 | Tran | 123/196 S |

*Primary Examiner*—Erick R. Solis

[57] ABSTRACT

An apparatus for automatically preventing wear in an internal combustion engine includes an electric pump, a disconnect coupling, a high arrestance filter, a programmable logic control element, an electric fan assisted radiator, an external controller. The programmable logic control element is connected to a normally provided battery and automatically switches control power from the battery to the electric pump according to a programmed control operating cycle program, and is operatively independent of ignition switch activation or operator action. The inlet of the electric pump is connected to the normally provided engine oil sump for removing lubricating fluid. The lubricating fluid is pumped through the high arrestance filter, yielding a substantially contaminant free lubricating fluid which after flowing through the radiator is discharged into the normally provided engine lubricating gallery. The external controller, such as a wireless remote control, is provided to activate the pump remotely upon demand. The disconnect coupling is provided to facilitate evacuation of the oil sump for the purpose of an oil change by overriding automatic operation of the electric pump by a local control switch. In a second embodiment the inlet of the electric pump is dimensioned to be affixed and fluidly connected to the oil sump, and the radiator is eliminated. In another embodiment the inlet of the pump is connected to a hollow tube dimensioned for insertion into the dipstick well to gain access to the oil in the sump. Yet another embodiment, a pump assembly dimensioned as the normally provided oil filter replaces the filter, and it encloses in its volume the programmable control element connected to the electric pump whose inlet is connected to the oil sump, with the pump outlet connected to the oil gallery, and further including a transverse oil filter cartridge to provide for filtration during normal engine operation.

20 Claims, 5 Drawing Sheets

AUTOMATIC METHOD AND APPARATUS FOR PREVENTING WEAR IN AN INTERNAL COMBUSTION ENGINE

BACKGROUND—FIELD OF THE INVENTION

The present invention relates to internal combustion engines, and more particularly to improvements, to a method and apparatus for admitting a lubricating fluid into the existing lubrication system of those engines for prelubricating the engine before start-up to reduce wear on the moving parts of the engine.

BACKGROUND—DESCRIPTION OF THE PRIOR ART

Internal combustion engines depend for their proper lubrication to be already running. During start-up, proper lubrication is not immediately achieved since all the oil or lubricant in the normally provided engine oil galleries is evacuated by gravity action. After the elapsing of a period of time, the oil adhered to the slidable working surfaces, engine lubricating galleries, and parts, drains to the bottom reservoir or oil sump. This leaves the slidable working surfaces unprotected from wear during the next start-up. McDonnell Douglas has performed tests which indicate that up to 90 percent of the wear in an internal combustion engine occurs during such start-ups or dry-starts due to oil starvation. Other wear mechanisms account for substantial wear in engines. These wear mechanisms are attributed mainly to suspended solid particles and chemical contaminants in the lubricating oil.

Most prior art systems addressing this problem rely on activation immediately prior to and/or during starting of the internal combustion engine. These methods introduce inconveniences such as waiting for the operating cycle to occur, required operator action, and difficult installation. Such inconvenient time delay is irritating to the vehicle operator and in some prior art may even be dangerous should the vehicle stall and needs to re-start immediately. There still is the long-felt need to have a system that delivers the desired benefits automatically, without waiting, and easily installed. In addition, prior art does little to address the added benefits of removing solid and chemical contaminants from the lubricating oil in combination with their prelubricating functions. Such contamination contributes substantially to engine wear and physical degradation of the engine lubricating oil. Normally provided filters in automobiles remove suspended solid particles larger than approximately 25 microns. Introduction of a filter rated for much higher arrestance for suspended solids with the additional function of separating chemicals from the oil and cooperating with the present invention solves and additional wear problem not addressed in prior art.

Prior art devices are required to be larger and more complicated installations because they need to overcome the specification of quick on demand delivery of lubricating oil. The present invention suggests and discloses a method and apparatus with an automatic system which substantially delivers the expected benefits, with the unexpected result of no waiting time and inherent reduction in size and cost. Further, it addresses additional wear mechanisms by simultaneous removal of solid and chemical contaminants from the lubricating oil.

Some prior art depend for their performance on a compressed chamber of potentially flammable liquid inside a hot engine bay. Rupture of the holding chamber inside a hot engine bay will produce a fire and environmental hazard. For example, a preoiling system depicted in U.S. Pat. No. 2,736,307, which issued to Wilcox on February 1956, includes a high pressure pump for charging a reservoir with engine oil which is released by engagement of the starter switch. Another type of lubricating system, depicted in U.S. Pat. Nos. 2,755,787 and 3,422,807, releases oil from a reservoir as the ignition is activated. A preoiler with a solenoid valve is shown in U.S. Pat. No. 3,556,070 and U.S. Pat. No. 3,583,525. A valve arrangement, depicted in U.S. Pat. No. 3,583,527, which issued to Raichel on June 1971, controls the charge and discharge of a reservoir of oil under pressure in response to the closing of the ignition switch. Another engine preoiler, disclosed in U.S. Pat. No. 4,061,204, includes a valve arrangement in the base of an accumulator having multiple ports. U.S. Pat. No. 4,094,293 depicts an engine pre-oiler with a pressurized reservoir for containing engine oil. Yet another prelubrication device depicted in U.S. Pat. No. 4,112,910, shows a holding mechanism for a coiled power spring which is released on actuation of the ignition system whereupon oil in a chamber is evacuated. U.S. Pat. No. 4,359,140, which issued to J. Shreve on Nov. 16, 1982, discloses an auxiliary engine oiler including a reservoir for storing a lubricant under pressure. Another approach is U.S. Pat. 5,156,120, which issued to Kent on Oct. 20, 1992, discloses a system with an accumulator for holding lubricant under pressure and returning the lubricant upon engine start-up. Yet another prelubrication system, depicted in U.S. Pat. No. 4,703,727, which issued to Cannon on November 1987, shows a high pressure oil pump, controlled by an ignition switch and an oil pressure sensor, for supplying oil to an engine immediately prior to start-up. These systems introduce inconvenience, safety and potential environmental problems.

Another approach is to provide a prelubrication system such as those disclosed in U.S. Pat. Nos. 3,066,664, which issued to McNew et al. on December 1962; 3,722,623, Waldecker; 3,842,937, Lippay et al.; 4,157,744, Capriotti; 4,168,693, Harrison; 4,524,734, Miller; 4,502,431, Lulich; 4,834,039, Apostolides; 4,825,826, Andres; 4,875,551, Lulich; 4,893,598, Stasiuk; 4,936,272, Whitmore; 4,940,114, Albrecht; and 5,000,143, which issued to Brown on March 1991. Generally, these patents disclose supplementary oil pumping systems which inject oil into the engine immediately prior to cranking and/or start-up. Although these references partially address the problem of prelubricating the engine, there are many undesirable design drawbacks and unrecognized problems to such systems. Additional elements in prior art increase the complexity and costs of installation and maintenance of such systems, as well as the space requirements in an already cramped engine bay. Some have required original fabrication of at least some of its components. Consequently, the size, complexity, cost and problems associated with the installation and maintenance of such systems has prevented their widespread use in most vehicles. It is estimated that less than approximately 1 in 10,000 automobiles have an engine prelubrication system.

Another approach is U.S. Pat. No. 4,199,950, which issued to A. Hakanson et al. on Apr. 29, 1980, which discloses a system for prelubricating an engine during starting in the form of an atomized mist generated by a nozzle operating under high pressure conditions. U.S. Pat. No. 4,502,431, which issued to J. Lulich on Mar. 5, 1985, discloses an oil pumping system driven from the starter motor which generates oil pressure prior to start-up.

Another approach is U.S. Pat. No. 5,195,476, which issued to Schwarz on Mar. 23, 1993, discloses a system for prelubricating an engine by using the pump provided by the manufacturer as a means to pressurize the oil immediately before start-up, but at the expense of introducing undesirable wear and tear on the starting and electrical system, and inconvenience. U.S. Pat. No. 5,121,720, which issued to Roberts on June 1992, discloses a prelubrication system that operates upon the operator opening the door, with the problem of inconvenience, and unnecessary wear and tear of the apparatus due to false open door signals.

Yet another approach is found in U.S. Pat. 5,488,935 issued to R. L. Berry Jr. on Feb. 6, 1996, which discloses a single charge pressurized oil injection system comprising a pressure accumulator and a normally closed electromagnetic valve operated when the ignition switch is turned to the on position. Other relatively unsafe hydraulic accumulators have been provided in prior art which could be applied in the field of invention. For example, U.S. Pat. No. 2,300,722 to Adams et al. which issued on November 1942; U.S. Pat 2,394,401 to Overbeke; U.S. Pat. No. 2,397,796 to Lippincott; U.S. Pat. No. 4,769,989 to Oswald et al.; U.S. Pat. No. 5,197,787 to Matsuda et al.; and U.S. Pat. No. 5,494,013 to Helbig, which issued on February 1996, are illustrative of such prior art.

One recent approach to this problem is to introduce into the engine oil chemical additives which cling to the walls of the cylinders and other movable parts after the engine is shut off. These additives have questionable effectiveness and permanency, since their effectiveness is extremely difficult, if not impossible, to ascertain or verify. In addition, booster doses are needed periodically due to degradation and oil changes. However, the present invention cooperates and enhances whatever possible benefits of this approach by automatically and periodically delivering the treated oil to the required working surfaces.

Each of the noted patents deals with the dry-start problem in either an incomplete or ineffective manner, unsafe, potentially dangerous by way of holding pressurized combustible material inside a hot engine bay; or by way of complex, energy intensive, and costly apparatus due to real time on demand immediately prior to start-up requirements. Therefore, most prior art prelubrication systems supply oil to the engine parts, immediately prior to ignition and while the operator waits for the cycle to occur, introducing various undesirable and costly design trade-offs, and high levels of inconvenience to the user operator. More specifically, the mutually exclusive design requirements of reducing the cycle time prior to start-up at the expense of increased pump size, energy demands, and volumetric capacity. In other words, a pump or reservoir under pressure is unable to deliver the desired prelubricating functions instantaneously or in zero time. Therefore, the foregoing prior art references operating strategies are inherently inconvenient, or in the case of chemicals, hard to verify their effectiveness.

Accordingly, there has continued to be a need for a prelubricating system which is effective, simple, inexpensive to manufacture and operate, which is easy to install in an existing engine without major modifications to the engine assembly. A system which automatically and simultaneously cooperates in adding to its prelubricating functions the functions of engine lubricating gallery priming and removal of contaminants from the lubricating oil to further enhance the system wear reduction capabilities by addressing additional wear mechanisms. A system which enjoys favorable design trade-offs due to its method of operation, and more specifically benefits related to substantial reduction of size and hardware, and increased convenience. A system which is easily adapted to automobile production lines as an internal part of the engine due to its inherent size. A system which is safe to operate in a confined high temperature engine bay, and that delivers wear reduction and oil purification results automatically. A system that delivers the desired results automatically, by including unsuggested modifications in prior art. And more specifically, a system which performs its programmed operation without having the user wait a single moment immediately prior and independent of engine start-up or ignition switch, resulting in a system which delivers the highest possible convenience to its user operator.

SUMMARY OF THE INVENTION

The present invention solves the problems encountered in prior art with a method and apparatus which in addition to its automatic prelubricating function delivers automatic priming, automatic purification of the lubricating oil, independence from engine start-up or ignition switch, ease of installation, and convenience in its operation. The system includes a programmable control element which periodically controls a pump having its inlet connected to a suitable point where a lubricating oil is normally located in an engine. The lubricating oil is pressurized and discharged by the pump through a commercially available high arrestance filter for the removal of solid and chemical contaminants in the lubricating oil. The system discharges the oil into the normally provided lubricating gallery of an internal combustion engine.

The mechanisms of wear in an engine are caused by the absence of oil from wear intensive surfaces during start-up, the time required to fill up the oil supply system and engine galleries immediately after start-up, abrasion during running caused by solid contaminants suspended in the lubricating oil, and chemical contaminants in the lubricating oil which attack metallic surfaces and degrades the lubricating properties of the lubricating oil. The pump of the present invention is actuated for a predetermined duration by a solid state timing control device, solid state controller, programmable digital logic controller, or electronic controller which automatically switches control power from the normally provided battery to the pump. The pump removes contaminated oil from the oil sump and delivers substantially purified lubricating fluid to the lubricating galleries in the engine. After the elapsing of a predetermined period of time, the cycle is repeated. Therefore, this periodic action keeps internal moving parts substantially prelubricated at all times with purified lubricating oil prior to the next start-up cycle, keeps the engine galleries substantially primed or filled up to reduce the time required to reach normal oil pressure, removes solid particles suspended in the lubricating oil, and removes the chemical contaminants from the lubricating oil.

OBJECTS AND ADVANTAGES

Accordingly, there exists a need for an engine wear prevention system which will reduce engine wear and will be simpler, less expensive, more space efficient, and more easily installed and maintained than prior art prelubricating systems.

It is therefore, a primary object of the present invention to provide an engine wear prevention system that, is automatic and independent of engine start-up or ignition switch activation, which includes unappreciated advantages and unsuggested modifications in prior art, that has all the advantages and the additional complementary wear prevention benefits from the functions of priming and oil filtering, and has none of the unrecognized problems and undesirable design shortcomings found in prior art.

An additional object of the present invention is to provide an engine wear prevention system, that includes previously unsuggested modifications which automatically and simultaneously removes contaminants and suspended wear causing particles from the lubricating oil, that automatically primes the internal engine lubricating galleries with substantially purified lubricating oil, and that automatically prelubricates the engine wear surfaces with substantially purified lubricating oil.

A further object of the present invention is to provide an engine wear prevention system, that is automatic and does not require ignition switch activation or engine operator action immediately before start-up for its operation, in order to overcome the unrecognized problem of waiting in prior art.

An additional object of the present invention is to provide an engine wear prevention system, that includes a commercially available solid state timing control device, programmable controller, or programmable digital logic control element which stores or adapts an optimized preprogrammed operating strategy to maximize convenience, wear prevention functions, and to minimize system activation to increase the longevity of the system.

Yet another object of the present invention is to provide an engine wear prevention system, that is compact, modularly designed and manufactured from commercially available components, as a result of favorable design trade-offs, having a compact modular unit formed by an electric pump in combination with a solid state programmable control element.

A further object of the present invention is to provide an engine wear prevention system, that solves the unrecognized problems of installation and unfavorable design shortcomings related to single function, inherent larger size, larger energy demands, oil volume variations, and added hardware of prior art devices.

A still further object of the present invention is to provide an engine wear prevention system, that has favorable design trade-offs and synergies, and the unrecognized advantage of a low cost of manufacture with regard to both material and labor, and which accordingly has the advantage of low price of both sale and installation to the consuming public, thereby making such engine wear prevention system economically available to the buying public.

Yet another object of the present invention is to provide an engine wear prevention system, that is safer and more environmentally responsible when compared to prior art which utilizes a pressurized oil accumulator in combination with an ignition switch controlled electromagnetic valve immediately prior to start-up.

A further object of the present invention is to provide an engine wear prevention system, that is a more easily installed engine part in an automobile assembly line due to the unexpected results of its operating strategy and the resulting previously unappreciated advantage of its inherently smaller number of parts, readily accessible connection points, and physical size than prior art prelubrication systems.

Another object of the present invention is to provide an engine wear prevention system, that requires for electrical connection only one pair of wire means, which does not require connection to the ignition switch or other dash installed switch, and that leads to a more easily installed and safer device.

Yet another object of the present invention is to provide an engine wear prevention system, that is a more compact and easily installed accessory in current and older motor vehicles due to its inherently smaller number of parts, number of easily accessible connection points, and physical size than prior art prelubrication systems.

A still further object of the present invention is to provide an engine wear prevention system, that automatically primes the internal lubricating galleries of said engine with substantially purified lubricating oil to reduce wear by substantially reducing the time required by the engine to reach normal pressure immediately after start-up.

Yet another object of the present invention is to provide an engine wear prevention system, that is easily available to the buying public and through its adoption on a large scale will contribute to the enhancement of the environment by making engines run more efficiently, avoiding waste of national resources, and deferring the use of natural resources.

Further objects of the invention will appear as the description proceeds and claims drawn. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

The present invention will be more fully understood by reference to the following detailed description thereof when read in conjunction with the attached drawings, in which like reference characters designate the same or similar parts throughout the several views, wherein.

REFERENCE NUMERALS IN DRAWINGS

Figures 1, 1A:
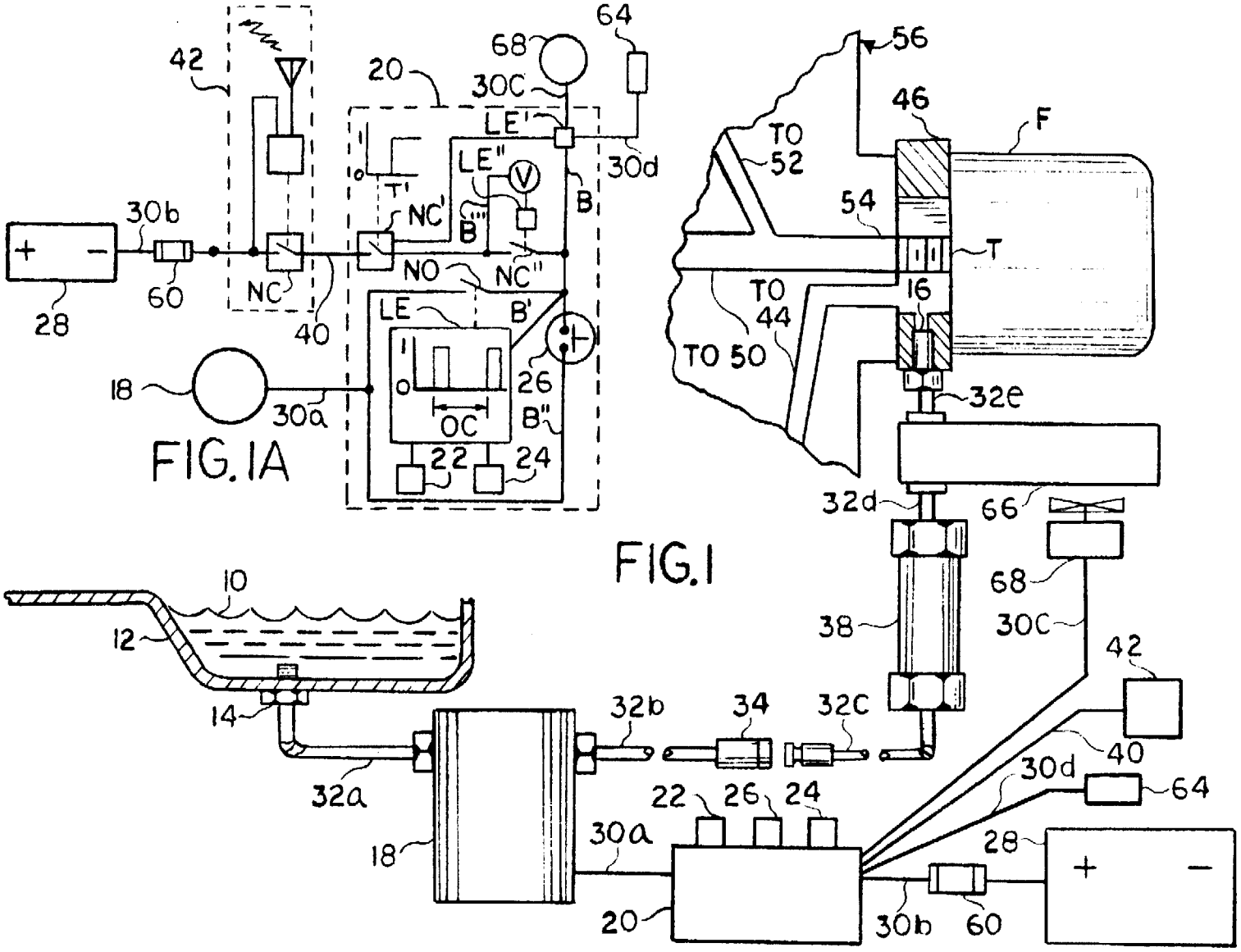
FIG. 1 is a detail side view illustrating the components of the engine wear prevention system according to a first embodiment of the present invention installed on a conventional engine block.
FIG. 1A is a diagrammatic view illustrating and further clarifying the block diagram connection of electric components shown in FIG. 1 according to an example mode.

10. Lubricating oil
12. Oil sump
14. Modified drain plug
16. Check valve
18. Electric pump
20. Programmable control element
22. Means or Duration control knob
24. Means or Frequency control knob
26. Local control switch
28. Battery
30. Standard wire means
32. Conduit
34. Disconnect coupling
36. Hydraulic connector
38. High arrestance filter
40. Standard wire means for remote operation
42. External controller
44. Internal lubricating pump
46. Three-way hydraulic coupling
48. Dipstick well
50. Crankshaft relative motion metallic surfaces
52. Camshaft relative motion metallic surfaces
54. Engine lubricating gallery
56. Internal combustion engine
58. Bypass check valve
60. Low ampacity fuse
64. Temperature sending unit
66. Radiator
68. Electric auxiliary fan
70. Hollow dipstick assembly
72. Transverse oil filter cartridge
74. Assembly case
76. Assembly adapter
78. Diaphragm electric pump
80. Pump assembly
82. Electrical connector
84. Outlet chamber
86. Inlet check valve
88. Outlet check valve
90. Pump working chamber

MODE OF OPERATION

The present invention method and apparatus is based on automatic operation made possible by the inclusion of a solid state timing control device, solid state controller, programmable digital logic controller operatively connected to a hydraulic electric pump. This programmable control element switches electric control power from a normally provided battery to an electric pump according to a programmed operating strategy. Inclusion of an electronic programmable control element leads to favorable design trade-offs and cooperating benefits in the form of simultaneous prelubricating, priming, and lubricant purifying. Additional benefits are found in the design, manufacture, simplicity, installation, safety, and convenience to the user. Furthermore, much smaller hardware size and power consumption is needed, since delivery time of the lubricating fluid is no longer of importance to the operator. This is possible because the present invention delivers the desired results automatically without human intervention. Therefore, function delivery time is of no relevance, and waiting immediately before engine operation as widely suggested in prior art is eliminated.

The present invention takes advantage of the viscous properties of the lubricating oil, high viscosity gradient with respect to temperature, capillary forces, engine cool-down cycles, the small volume of oil that typical lubricating galleries require to fill-up, and the increasing time required for a viscous oil to flow from cooling surfaces typically separated by tight mechanical tolerances inside the conventional engine.

If a commercially available electric hydraulic pump delivers a lubricating oil to overfill the engine lubricating galleries. In addition, the engine has ceased operation and therefore is cooling down resulting in an increasing lubricating oil viscosity index over time. Further, the ability of the lubricating oil to flow is also decreasing as its temperature decreases. In addition, the period between automatic pump operations is smaller than the period of time required for the lubricating oil to drain from the desired wear intensive surfaces and passages. And lastly, a high arrestance filter is introduced in series with the hydraulic pump that processes incoming dirty lubricating oil into purified and substantially analytically clean oil. Therefore, the engine will automatically and simultaneously be substantially prelubricated to avoid wear during start-up, will reach normal oil operating pressure sooner upon start-up, will continuously have substantially cleaner oil due to automatic filtration, and it will be extremely convenient to use by eliminating operation immediately before start-up as suggested in the prior art.

Elimination of on-demand constraints found in prior art requiring operation immediately before and/or during start-up will lead to solving the unrecognized problem of inconvenience in prior art. It will also result in very favorable and previously unappreciated advantages in design trade-offs, and synergies in the cooperating functions of prelubricating, priming, purifying, and evacuating lubricating oil from the oil sump for the purpose of routine oil change.

DETAILED DESCRIPTION OF THE DRAWINGS

Referring now to the drawings, FIG. 1 shows a schematic of my automatic method and apparatus for preventing wear in an internal combustion engine. As an operating part of an internal combustion engine 56 a lubricating oil 10 contained by a normally provided oil sump 12, is allowed to flow through a modified drain plug 14 connected to an intake conduit 32*a*. Modified drain plug 14 has a center channel to allow lubricating oil to flow from oil sump 12 to conduit 32*a*. Intake conduit 32*a* is connected to an inlet of an electric pump 18. Electric pump 18 outlet is connected to an outlet conduit 32*b*. Outlet conduit 32*b* is connected to a male-female quick disconnect self-sealing coupling, or a disconnect coupling 34. The complementary part of disconnect coupling 34 is connected to a filter intake conduit 32*c*.

Electric pump 18 is controlled by a commercially available solid state timing control device, solid state controller, programmable digital logic controller, or a programmable control element 20. Programmable control element 20 can be adjusted to automatically control operation of electric pump 18 in terms of duration, and frequency or period of operation. Programmable control element 20 is well known and is commercially available in customized form from many manufacturers. Programmable control element 20 draws power for its operation and switches control power to electric pump 18 from a normally provided automotive battery 28. Duration means or a duration control knob 22 and frequency means or a frequency control knob 24 allow for controlling electric pump 18 operating duration, and frequency or period of operation. These operating parameters are related to engine size, frequency of engine operation, ambient temperature, driving habits, operating time, oil change interval, among others. In the case of a programmable controller, the predetermined parameters can be evaluated to produce a combination of frequency and duration of operation that optimizes the automatic method. Such strategy stored in read-only memory in such well known programmable controllers offers improved performance over a simple recycling timer. An even further refinement can be obtained from a commercially available adaptive controller which learns by continually modifying the settings for frequency and duration.

Still referring to FIG. 1, programmable control element 20 can be an on-off recycling timer equipped with independently set duration control knob 22 and frequency control knob 24. This timer is capable of a multitude of combinations within a range continuum to satisfy a multitude of operating conditions. As an adaptive controller, programmable control element 20 can optimize its function by learning operating conditions of internal combustion engine 56. These solid state controllers continually optimize and adjust frequency and duration of operation of pump 18 when compared to a predetermined ideal mode of operation. A local control switch 26 is also provided to override control element 20 to perform on demand operation of electric pump 18. This is done for the purpose of evacuating lubricating oil 10 from oil sump 12 for an oil change after manually disconnecting disconnect coupling 34.

Programmable control element 20 switches control power from battery 28 by standard wire means **30*b* in series with a low ampacity fuse 60 for electric overload protection. Programmable control element 20 is also connected through standard wire means 40 to a remote operator, or an external controller 42. External controller 42 can be, among others, a commercially available wireless remote control. For example, this external controller can momentarily de-energize control element 20, for approximately 2 seconds. Upon re-application of power, control element 20 resets for an "on time first" operation, rendering the present invention superior to prior art devices requiring activation immediately prior to start-up. This is because the previous automatic operation has substantially left the engine prelubricated, and therefore only a small volume of oil is needed to reach substantial prelubrication and priming. Programmable control element 20 is electrically connected to electric pump 18 by standard wire means 30*a* for the purpose of switching and delivering control power from battery 28. In addition, commercially available programmable control element 20 can be customized with voltage sensing logic means to cease all operation if a preset low voltage level is detected. This is specified in order to avoid discharge of battery 28**.

Now referring to FIG. 1, filter intake conduit **32*c* is connected to an inlet port of a high arrestance filter 38. High arrestance filter 38 is commercially available with added and enhanced filtering capabilities. Filter 38 is available with substantially higher arrestance rating and chemical removing capabilities than the conventionally supplied oil filter F. Normally provided oil filter F generally performs by removing suspended solid particles larger than approximately 25 microns. High arrestance filter 38 is commercially available with ratings of approximately 1 or 2 microns. The oil discharged from high arrestance filter 38 is substantially free from suspended solid and dissolved contaminants according to the design parameters and rating of filter 38. The automatic process of the present invention will provide for lubricating oil 10 to be substantially free from particles approximately larger than 1 or 2 microns and chemicals removed from the oil according to design parameters of filter 38**. These added filtering capabilities will result in reduced engine wear due to increasingly cleaner lubricating oil used for prelubricating and priming.

Still referring to FIG. 1, oil filter 38 outlet is connected to a filter outlet conduit **32*d* which is connected to an inlet port of a heat exchanger, or a radiator 66. An electric auxiliary fan 68 is also controlled by programmable control element 20. Fan 68 is connected to control element 20 by standard wire means 30*c* for control power. A temperature sending unit 64 is connected to programmable control element 20 by standard wire means 30*d*. Sending unit 64 provides a signal to programmable control element 20 to control operation of auxiliary fan 68. Such signal activates programmable control element 20 according to predetermined operating conditions stored in the form of read-only memory as found in well-known commercially available programmable control elements. Temperature sending unit 64 can be a normally open or closed thermal switch to disable or enable the system. Radiator 66 outlet port is connected to a radiator outlet conduit 32*e*. A check valve 16, is installed in series with radiator outlet conduit 32*e* to prevent backflow of lubricating oil and facilitate electric pump 18 priming. Radiator outlet conduit 32*e* is connected to a tee hydraulic connector, or a three-way hydraulic coupling 46**.

Figure 2A:
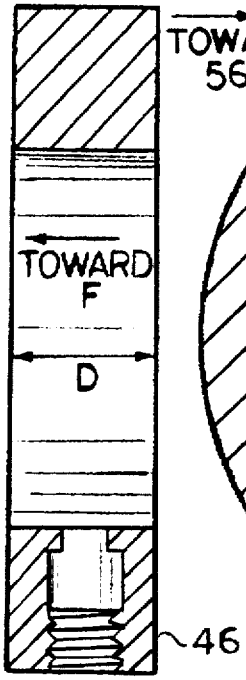
FIG. 2A is a longitudinal cross sectional view of a tee hydraulic connector means, or a three-way hydraulic coupling of the present invention which provides for passage of lubricating oil between the wear prevention system and the engine gallery.
Figure 2B:
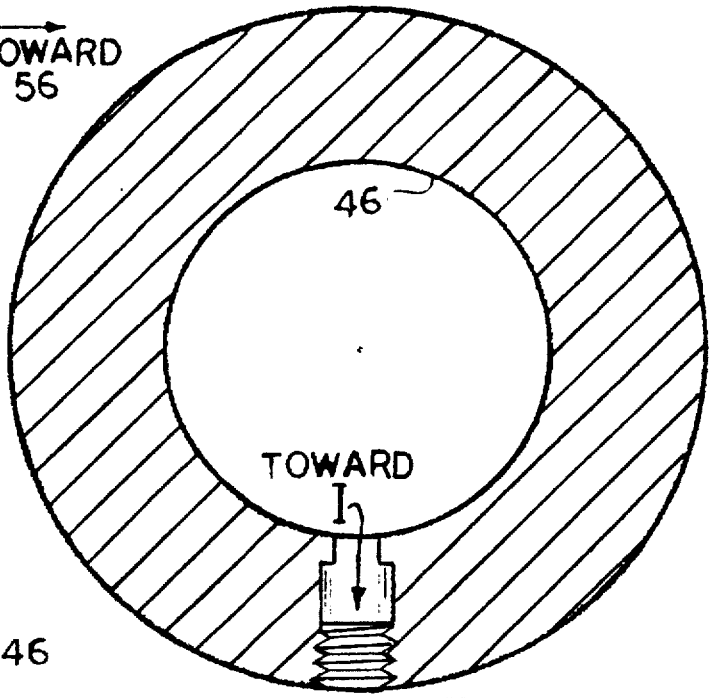
FIG. 2B is a transverse cross sectional view of the tee hydraulic connector means, or three-way hydraulic coupling of the present invention which provides passage of lubricating oil between the engine wear prevention system and the engine gallery.

Now referring to FIG. 1, FIG. 2A, and FIG. 2B, three-way hydraulic coupling 46 is provided to simultaneously connect three hydraulic points or systems. These three hydraulic points or systems are the present invention I, the normally provided engine gallery 54 through the normally provided oil filter F, and an outlet of normally provided engine pump 44. It is now apparent to those skilled in the art, that the independence of on demand requirements allows for a simpler and easily installed three-way hydraulic coupling means. Since pressure drop from fluid delivery rate is minimized by independence from delivery time, conduit connecting hardware is by consequence smaller. This coupling can be made in the shape of a flat doughnut with a thickness D within a range of 0.25 to 0.75 inches and connected to the outlet of the present invention, and with an external diameter to match the diameter of the normally provided filter. In addition, an internal diameter, or void, large enough to accommodate a diameter of a normally provided oil filter threaded point of connection T. Now referring to FIG. 1, this thickness allows for the three-way hydraulic coupling 46 to cooperate with the normally provided oil filter threaded point of connection T to further ease installation. Three-way hydraulic coupling 46 is simply sandwiched between filter F and engine block of engine 56. The apparatus of the present invention can easily be installed on a typical engine without the use of specialized tools, or mechanical skills, or drastic modifications to the engine. Of course, another well known accessible point is for a common tee hydraulic connector simultaneously connecting the present invention, the normally supplied engine oil pressure sending unit, and the normally supplied point of connection of the oil pressure sending unit which is generally connected to the engine lubricating gallery. Still referring to FIG. 1, radiator outlet conduit **32*e*, engine sending unit or engine pump 44 outlet, and engine gallery 54 through filter F, are interconnected by three-way hydraulic coupling 46. In this way lubricating oil 10 is routed into and through engine lubricating gallery 54**.

Still referring to FIG. 1, engine lubricating gallery 54 is connected, as part of engine design to smaller galleries connected to typical locations where slidable metallic surfaces exist. Such as, to crankshaft relative motion metallic surfaces 50 and to valve train relative motion metallic surfaces 52. Upon automatic operation of the present invention, lubricating oil 10 is made to flow into engine lubricating gallery 54 through filter F. The lubricating oil 10 drips and flows back to oil sump 12 through natural gravity action after bathing, sticking, and impregnating the substantially purified lubricating oil to relative motion metallic surfaces 50 and 52, thus completing the automatic operating cycle of the present invention.

The operating cycle is defined as the elapsing time of a predetermined duration, and thereafter the elapsing of a predetermined period of time. The predetermined duration, during which the electric pump is actuated, is within a range of 5 to 240 seconds and the predetermined period of time, during which the pump is off, is within a range of 4 to 180 minutes in order to accommodate most operating conditions. The elapsed time of the operating cycle is smaller than the time required for gravity to fully evacuate the lubricating oil from the lubricating galleries and internal moving metallic surfaces. In addition, the system allows for quick and convenient evacuation of the engine oil for purposes of oil change.

Now referring to FIG. 1 A, it shows a diagrammatic view of an example mode of connection of the electrical components to further illustrate and clarify their block diagram interconnections in FIG. 1. Battery 28 is connected to standard wire means **30*b*. Low ampacity fuse 60 is interconnected to wire means 30*b*. In this connection mode, external controller 42 is interconnected in series with standard wire means 30*b* by standard wire means 40. External controller can be a commercially available wireless remote control which controls the state of a normally closed relay NC. Normally closed relay NC is momentarily opened to de-energize programmable control element 20. Upon returning normally closed relay to its normally closed state, programmable control element 20** resets for "on time first" operation.

Power is routed by standard wire means 40 connected to a normally closed relay NC' which is part of programmable control element 20. Programmable control element 20 can be customized with a logic element LE' and a logic element LE" for temperature sensing and voltage sensing respectively. Relay NC' and electric auxiliary fan 68 are controlled by logic element LE'. Sending unit 64 is connected to logic element LE' by standard wire means **30*d* and provides its logic input. According to predetermined temperature settings fan 68 is activated by LE' by switching power through an internally to control element 20 electric path B. Voltage sensing logic means V specified for programmable control element 20 provides input to logic element LE" to control a normally closed relay NC" for the purpose of avoiding battery 28 discharge. Control element 20 is available with a logic element LE internally powered by an electric path B' which stores the operating cycle OC in its normally provided non-volatile memory. The operating cycle OC can be alternatively set with duration control knob 22 and frequency control knob 24. Logic element LE controls a normally open relay NO to switch power through wire means 30*a* to electric pump 18 according to operating cycle OC. Programmable control element 20 is provided with local control switch 26 to activate electric pump 18 locally by bypassing logic element LE through internal electric path connection B". Internal power connections to logic elements internal to element 20** are well known, but for illustration a set of electric paths B, B', B", and B'" is shown.

PREFERRED AND ADDITIONAL EMBODIMENTS

Figure 3:
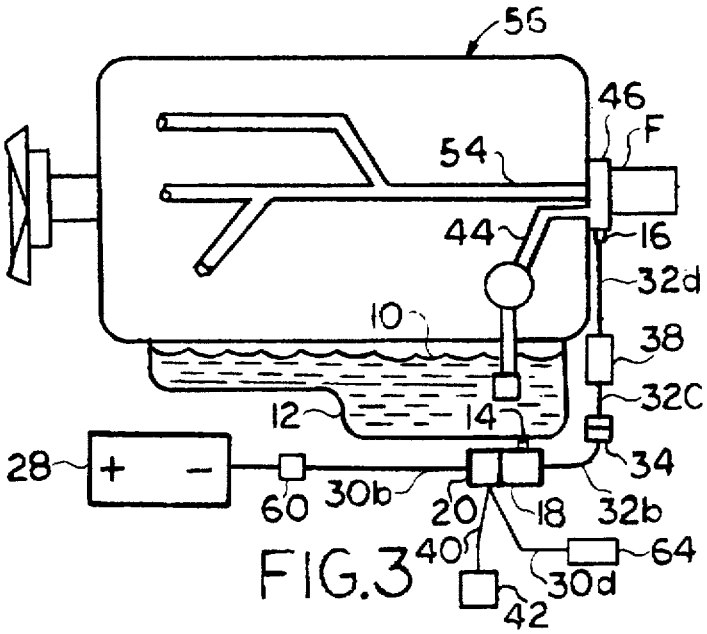
FIG. 3 is a side view illustrating diagrammatically the engine wear prevention system in an engine according to a second and preferred embodiment of the present invention with the programmable control element circuitry contained within the pump enclosure installed on a conventional engine block.

Referring now to the drawings, FIG. 3 shows a diagrammatic view of a second embodiment, or the preferred embodiment of the present invention. Now referring to FIG. 4, this drawing illustrates how the system removes lubricating oil 10 from the volume contained by the normally supplied oil sump 12. This removed oil 10 is made to flow through the modified drain plug 14 which is made to immediately mate to a properly sized inlet port of electric pump 18. This eliminates the need for conduit connecting inlet of electric pump 18 to oil sump 12.

Figure 4:
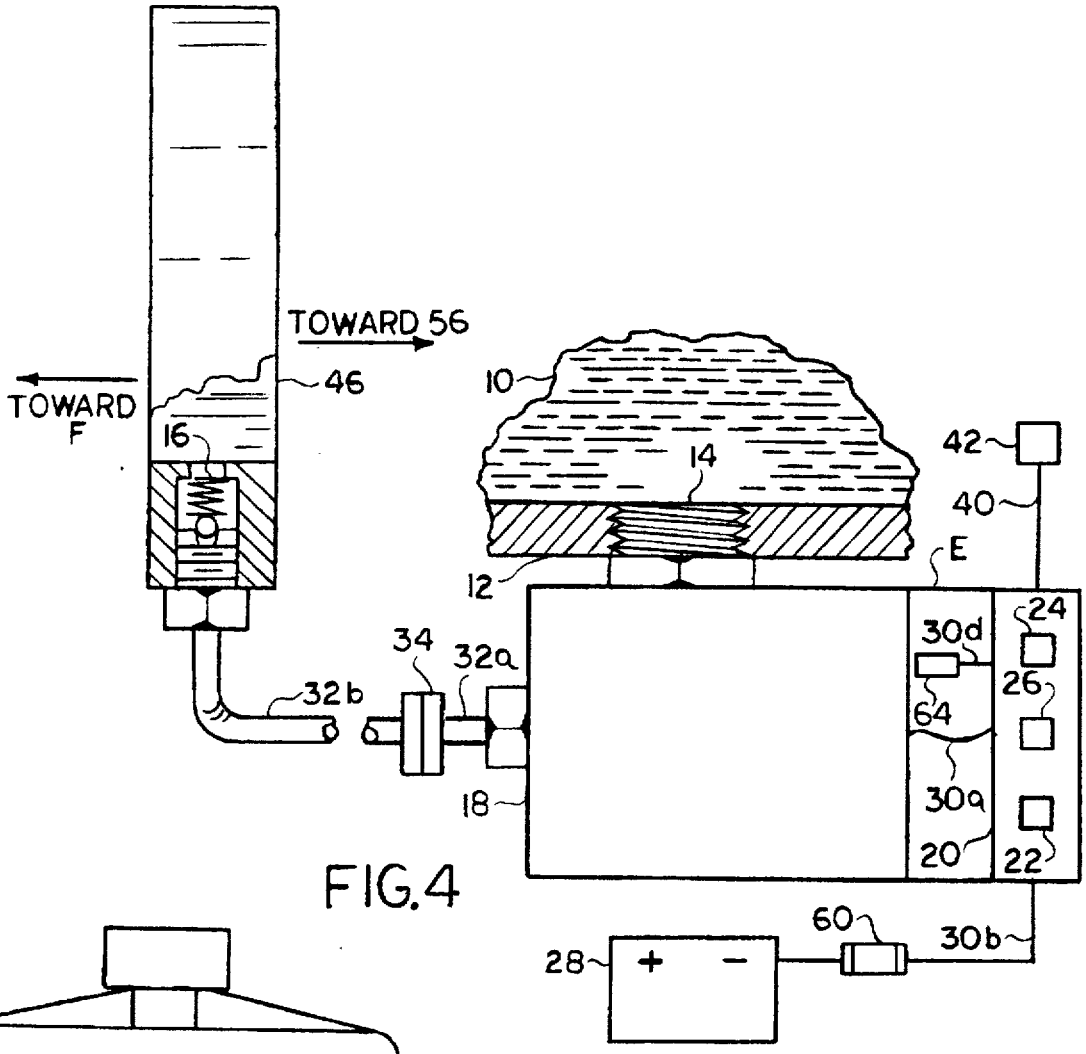
FIG. 4 is a side detail view illustrating the manner of attachment of the preferred embodiment showing the point of installation to the normally provided oil sump, and a detail side view illustrating the engine wear prevention system according to a third embodiment with the programmable control element circuitry contained within the pump enclosure installed on a conventional engine block.

Now referring to FIG. 3 and FIG. 4, Pump 18 operation is controlled by programmable control element 20. Programmable control element 20 is connected to electric pump 18 by standard wire means **30*a* to switch and deliver control power. Control power is switched according to the programmed operation in programmable control element 20. Programmable control element 20 draws its power and switches control power from battery 28 through wire control means 30*b* in series with low ampacity fuse 60. Now referring to FIG. 3, it is apparent from observing the drawing figure, that the operation of the present invention is independent of ignition switch operation, and relies solely on the programmed strategy stored in programmable control element 20. This strategy solves the unrecognized problem of inconvenience by providing an automatic device. This leads to design advantages by eliminating complicated wiring and failure points with a device needing one pair of wire means 30*b* connected to battery 28 and in series with low ampacity fuse 60. In addition, by eliminating the connection to the ignition switch as extensively disclosed in prior art, the present invention provides for an easily installed and electrically safer device. This increased safety is achieved by placing low ampacity fuse 60 at the most upstream point, electrically and physically next to battery 28**.

Still referring to FIG. 3, electric pump 18 outlet port is connected to outlet conduit **32*b*. Outlet conduit 32*b* is connected to disconnect coupling 34. The complementary part of disconnect coupling 34 is connected to filter intake conduit 32*c*. Oil 10 is made to flow through high arrestance filter 38, and discharged through oil filter 38 outlet port substantially free from contaminants according to operating parameters of oil filter 38. Oil filter 38 outlet port is connected to conduit 32*d*. Conduit 32*d* is connected in series with check valve 16. Check valve 16 is provided to facilitate priming and prevent flow of lubricating oil 10 through the system in reverse flow to normal operation while engine 56 is running. Now referring to FIG. 2A, FIG. 2B, and FIG. 3, three-way hydraulic coupling 46 simultaneously connects the normally provided oil pump 44 outlet, engine lubricating gallery 54** through filter F, and the present invention I.

Due to previously mentioned design advantages gained from the operating strategy, the present invention can be manufactured as a modular unit that directly attaches to the oil pan. In other words, a timed electric pump unit from commercially and readily available hardware.

Now referring to FIG. 4, this third embodiment is the present invention reduced to the simplest yet functional apparatus having a minimum amount of components. It shows the programable control element easily incorporated inside the normally provided enclosure E of the electric pump 18. This is easily done since control element 20 circuitry is relatively small. This third embodiment utilizes the same principle of operation and installation of the preferred embodiment. The programmable control element is provided with means or duration control knob 22, means or frequency control knob 24 and local control switch 26. It automatically provides the functions of priming and prelubricating. This embodiment does without inclusion of filter 38, radiator 66, and fan 68. However, it does include customized voltage detection means in programmable control element 20 circuitry to prevent full discharge of battery 28. It includes sending unit 64 connected to control element 20 by wire means 30*d*. Disconnect coupling 34 is connected to conduit means 32*a* and 32*b*. This embodiment is connected to the engine block in the same manner as the preferred embodiment by the three-way hydraulic coupling 46. It is now clear and apparent to those skilled in the art, that the favorable design trade-offs of the present invention operating strategy leads to an automatic, simpler, long-lived, convenient, easily installed, light in weight, compact, efficient, low energy demand, economical, and safe device.

Figure 5:
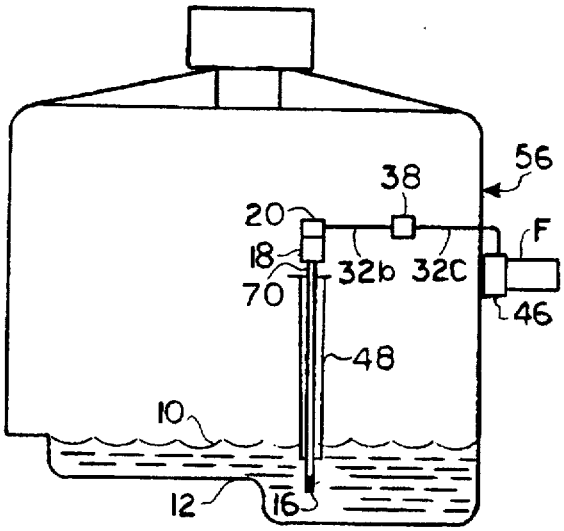
FIG. 5 is a side view diagrammatically illustrating the engine wear prevention system according to a fourth embodiment of the present invention installed on a conventional engine block.
Figure 6:
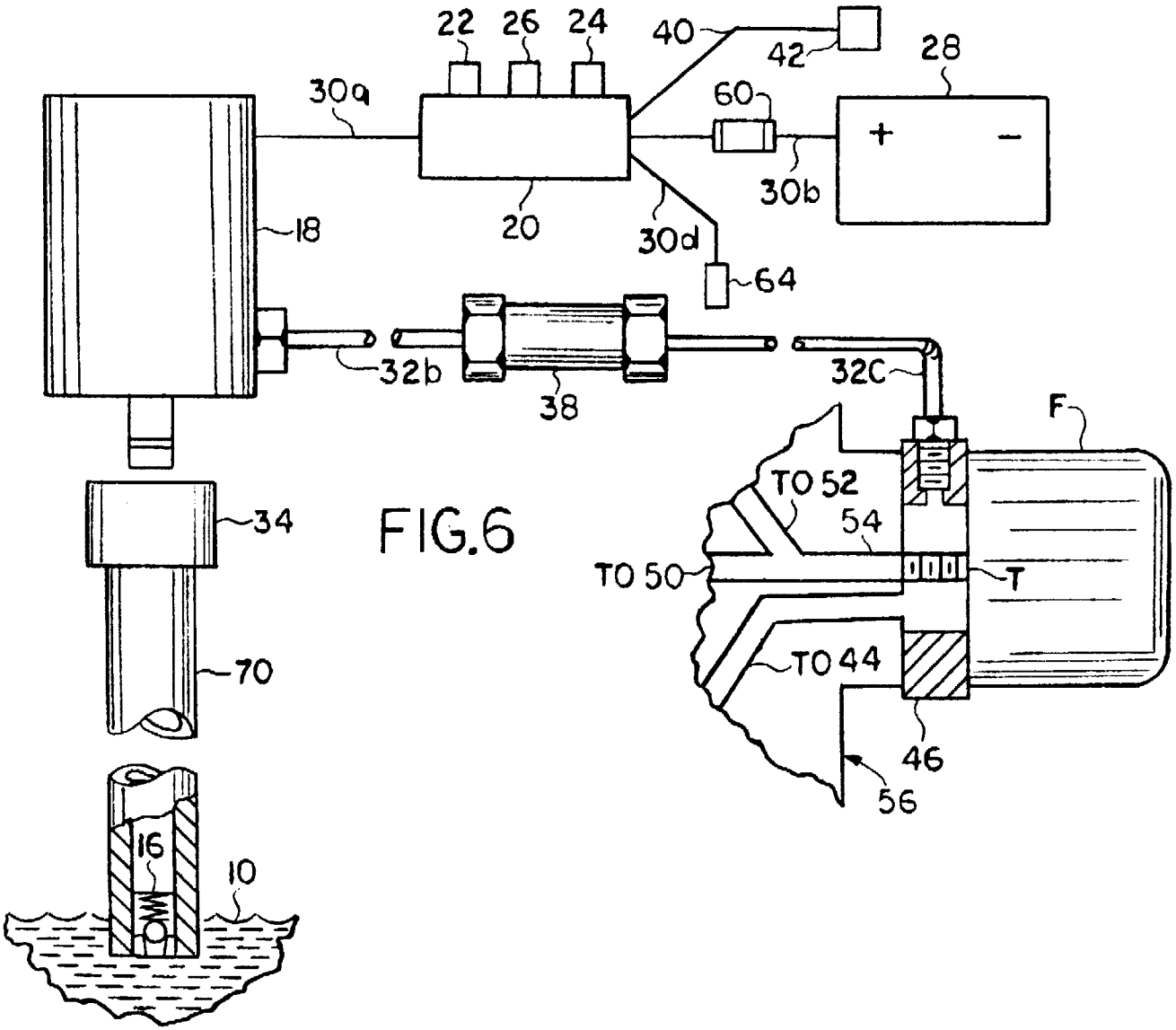
FIG. 6 illustrates a detail side view of the engine wear prevention system of the present invention according to a fourth embodiment including a hollow dipstick for oil intake into the system.
Figure 7:
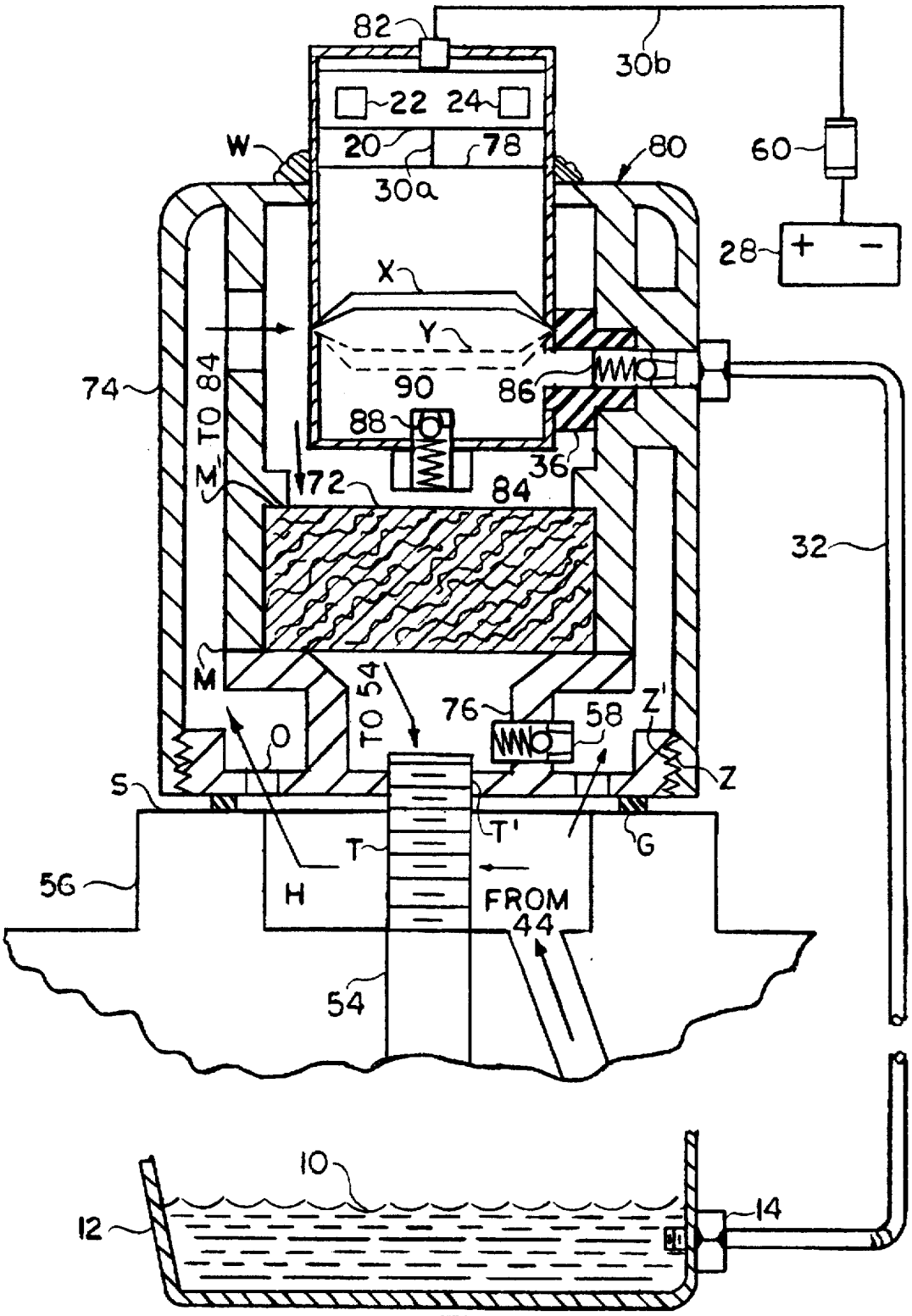
FIG. 7 is a sectional drawing illustrating the engine wear prevention system of the present invention according to a fifth embodiment which replaces the normally provided oil filter normally provided on a typical engine.

Now referring to FIG. 5, it shows diagrammatically a fourth embodiment of the present invention. This embodiment uses the same method of prelubrication by periodic operation of electric pump 18 by programmable control element 20 in terms of the duration and frequency of operation of pump 18. Now referring to FIG. 6, access to lubricating oil 10 is achieved through a hollow dipstick 70, equipped at its lower end portion opening with check valve 16 in direct fluid contact with lubricating oil 10 contained by the normally provided engine oil sump. Hollow dipstick is also provided with adequate markings at its lower end portion to indicate safe operating oil level in the oil sump. Now referring to FIG. 5, hollow dipstick 70 is dimensioned for insertion into a normally provided and well known engine dipstick well 48. Programmable control element 20 switches control power in the same manner of the preferred embodiment and the numerals refer to the same components. Now referring to FIG. 6, control element 20 is connected to remote operator 42 by standard wire means 40. Temperature sending unit 64 is also connected to control element 20 by wire means 30*d*. The upper opening of hollow dipstick 70 is directly connected to the inlet port of electric pump 18 through quick disconnect self-sealing coupling 34. Electric pump 18 outlet is connected to conduit 32*b*. Conduit 32*b* is connected to inlet of high arrestance filter 38. Outlet of high arrestance filter 38 is connected to filter outlet conduit 32*c*. Tee hydraulic connector or three-way hydraulic coupling 46 is connected in the same manner as the preferred embodiment. Three-way hydraulic connector 46 cooperates with normally provided threaded point of attachment T, and it also connects to engine pump 44 outlet which blocks the flow of injected oil due to its tight mechanical tolerances. Three-way connector is sandwiched between filter F and engine block of engine 56, by threading T into normal point of attachment of filter F. Three-way hydraulic connector allows for lubricating oil 10 to be discharged into and through engine lubricating galleries 54 through filter F to lubricate crankshaft working surfaces 50 and camshaft and valve train working surfaces 52 to complete the automatic prelubricating cycle as previously described in the preferred embodiment. A fifth embodiment is shown in FIG. 7, this embodiment departs from the preferred by eliminating most external hardware. This embodiment prelubricates the engine using the method disclosed for the preferred embodiment. This fifth embodiment discloses a pump assembly 80, cylindrical in cross section, which replaces the normally supplied disposable engine oil filter. A diaphragm electric pump 78 is fitted within the volume of pump assembly 80 and attached by a well known welding process, or any other well known bonding means, yielding a weld bead W to an assembly case 74. Assembly 80 encloses components with assembly case 74 mated to an assembly adapter 76. Assembly case 74 is cylindrical in shape to easily replace the normally provided oil filter. Assembly adapter 76 has a threaded section Z' around its outside periphery that mates with a corresponding threaded section Z found in the lower inside periphery of assembly case 74. Assembly adapter 76 is provided with threads T' to allow for attachment to the normally provided threaded point of connection T of the normally provided oil filter.

Assembly adapter is also fitted with a rubber seal G, circular in shape, to properly seal pump assembly 80 to the engine block surface S. Assembly adapter 76 is also equipped with a plurality of orifices O arranged in a circular pattern around its area in contact with pump 44 hydraulic outlet point H. When assembly case 74 and assembly adapter 76 are mated by screwing the mating threads Z and Z', before and upon making contact at surface M they sandwich, seal, and lock in place a transverse oil filter cartridge 72 which is cylindrical in shape, like a hockey puck, between surface M and surface M'. Pump assembly 80 is equipped with an inlet check valve 86, and an outlet check valve 88, which function is needed to leave a sufficient priming volume inside working chamber 90. These check valves are usually an integral part of the well known diaphragm pump. Electric pump 78 inlet is connected by a hydraulic connector 36 to an intake conduit 32. Intake conduit 32 is connected to modified drain plug 14. Modified drain plug 14 replaces the normally provided drainplug and it allows for easy access to lubricating oil 10 normally contained by the oil sump 12.

Still referring to FIG. 7, this embodiment equipped with diaphragm pump 78, shows a position X corresponding to suction, and a position Y corresponding to discharge of lubricating oil 10 contained inside working chamber 90. Charge of oil 10 is discharged into an outlet chamber 84. Electric pump 78 will pressurize lubricating oil 10 in pump working chamber 90, discharge oil 10 into outlet chamber 84 and deliver it through transverse oil filter cartridge 72 and into the conventionally provided engine lubricating gallery 54. A normally provided internal lubricating pump 44 has tight tolerances which prevent reverse flow through it while not running. Therefore, the pumped oil 10 will flow towards and into gallery 54. Normal filtering while engine 56 operates, is achieved by forced flow through transverse oil filter cartridge 72. Normal operating oil flow is shown by the arrows in FIG. 7. Transverse filter cartridge 72 can be replaced at the time of oil change, by unscrewing and separating assembly adapter 76 from assembly case 74. A bypass check valve 58 is fitted to assembly adapter 76 to allow for oil to continue flowing if transverse filter cartridge becomes clogged due to neglect by the user.

Control power for assembly 80 is switched to electric pump 78 using the same operating method for the preferred embodiment. Control element 20 is connected by wire means 30*a* to electric pump 78. Programmable control element draws power from the normally provided battery 28 by wire means 30*b* through an electrical connector 82. Low ampacity fuse 60 is provided in series with wire means 30*b* to protect for electrical overload. Programmable control element 20, equipped with duration control knob 22 and frequency control knob 24 operates pump assembly 80 as the preferred embodiment with respect to duration and frequency of pump 78 operation. It is also specified with voltage sensing means connected to logic means to avoid full discharge of battery 28. This compact assembly will deliver the desired lubricating characteristics of the preferred embodiment, resulting in automatic prelubrication of engine 56, without an external operator intervention, ease of installation, and with the highest level of convenience not achieved by prior art in the field of the present invention.

It will be understood that each of the elements described above, or two or more together may also find a useful application in other types of methods differing from the type described above.

It thus will be seen that there are provided systems which achieve the various objects of the invention and which are well adapted to meet the conditions of practical use and public welfare.

While certain novel features of this invention have been shown and described and will be pointed out in future claims, it is not intended to be limited to the details above, since it will be understood that various omissions, modifications, substitutions and changes in the forms and details of the device illustrated and in its operation can be made by those skilled in the art without departing in any way from the spirit and scope of the present invention.

I claim:

1. A method for preventing wear in an internal combustion engine having an ignition switch, a battery, an engine lubricating gallery, a lubricating oil, said method comprising the steps of:

a. providing a programmable logic control means coupled to an electric pump for automatically switching control power from said battery according to an operating cycle program;

b. programming into said programmable logic control means said operating cycle program which is defined as the elapsing of a predetermined duration and thereafter the elapsing of a predetermined period of time;

c. actuating said electric pump according to said predetermined duration in step b to pump and discharge said lubricating oil into said engine lubricating gallery;

d. thereafter, elapsing of said predetermined period of time; and e. thereafter, repeating steps c and d automatically according to said operating cycle program in step b; said steps being carried out continuously and independently of whether said engine is operating or not;

whereby said engine is automatically and adequately prevented from wear.

2. The method of claim 1 wherein said predetermined duration in step b is within a range of 5 to 240 seconds.

3. The method of claim 1 wherein said predetermined period of time in step b is within a range of 4 to 180 minutes.

4. The method of claim 1 wherein steps c, and e are independent of said ignition switch state.

5. A kit comprising an apparatus for preventing wear in an internal combustion engine having a battery, a normally provided oil filter point of connection on the engine block, an engine lubricating gallery, an oil sump, an engine pump outlet, an engine oil pressure sending unit and a normally provided point of attachment, a lubricating oil, said apparatus comprising:

an electric pump;

an inlet side of said electric pump dimensioned to be affixed and fluidly connected to said oil sump;

a first conduit means for fluidly connecting an outlet side of said electric pump to said engine lubricating gallery; and programmable logic control means coupled to said battery for automatically powering on, said electric pump regardless of whether said engine is operating or not.

6. A kit in accordance with claim 5 and further comprising a modified drain plug having a center channel to allow lubricating oil from said oil sump to flow to the inlet side of said electric pump.

7. A kit in accordance with claim 5 and further comprising a second conduit means for fluidly connecting said modified drain plug to said inlet side of said electric pump to dispose said electric pump away from said oil sump.

8. A kit in accordance with claim 5 and further comprising a check valve in said first conduit means for preventing said lubricating oil to flow from said engine lubricating gallery to said oil sump.

9. A kit in accordance with claim 5 and further comprising a low ampacity fuse interconnected with said battery for preventing electric overload conditions.

10. A kit in accordance with claim 5 and further comprising a high arrestance filter connected in said first conduit means for substantially removing contaminants from said lubricating oil.

11. A kit in accordance with claim 5 and further comprising a temperature sending unit operatively connected to said programmable logic control means for enabling and disabling said electric pump.

12. A kit in accordance with claim 5 and further comprising an external controller operatively connected to said programmable logic control means to activate said electric pump remotely.

13. A kit in accordance with claim 5 and further including a radiator in said first conduit means and an auxiliary electric fan operatively connected to said programmable logic control means for removing heat from said lubricating oil.

14. A kit in accordance with claim 5 and further including a disconnect coupling connected to said first conduit means for removing said lubricating oil from said oil sump.

15. A kit in accordance with claim 5 and further including a three way hydraulic coupling shaped as a flat doughnut having a thickness within a range of 0.20 to 0.75 inches interposed between said filter and said normally provided oil filter point of connection on the engine block for fluidly connecting said apparatus, said engine lubricating gallery, and said engine pump outlet.

16. A kit in accordance with claim 5 and further including in said programmable control means a voltage sensing logic means for ceasing automatic operation of said electric pump if a preset low voltage is detected for avoiding said battery being discharged.

17. A kit in accordance with claim 5 and further including a tee hydraulic connector for fluidly connecting said apparatus, said engine oil pressure sending unit, and said normally provided point of attachment for discharging said lubricating oil into said engine lubricating gallery.

18. A kit in accordance with claim 5, wherein said programmable logic control means is an adaptive controller.

19. An apparatus for preventing wear in an internal combustion engine having, a battery, an oil sump, a lubricating oil, a dipstick well communicating with said oil sump, an engine pump outlet, a normally provided oil filter point of connection on the engine block, an engine lubricating gallery, an ignition switch, said apparatus comprising:

a hollow dipstick dimensioned for insertion into said dipstick well;

a lower end portion of said hollow dipstick opening equipped with a check valve;

said lower end portion of said hollow dipstick opening submerged in said lubricating oil contained by said oil sump;

a plurality of adequate markings at said lower end portion to indicate quantity of lubricating oil in said oil sump;

a first of two complementary parts of a quick disconnect self sealing coupling provided at an upper end portion of said hollow dipstick;

an electric pump;

a low ampacity fuse interconnected with said battery to prevent electric overload conditions;

programmable logic control means coupled to said electric pump for automatically switching control power from said battery and operatively independent of said ignition switch state;

an inlet side of said electric pump dimensioned as a second of two complementary parts of said quick disconnect self sealing coupling;

a conduit means connecting an outlet side of said electric pump to said engine lubricating gallery;

a high arrestance filter connected in said conduit means for substantially removing contaminants from said lubricating oil;

a temperature sending unit operatively connected to said programmable logic control means for enabling and disabling said electric pump;

an external controller operatively connected to said programmable logic control means for activating said electric pump remotely; and a three way hydraulic coupling shaped as a flat doughnut having a thickness within a range of 0.20 to 0.75 inches interposed between said filter and said normally provided oil filter point of connection on the engine block for fluidly connecting said apparatus, said engine lubricating gallery, and said engine pump outlet.

20. An apparatus for preventing wear in an internal combustion engine having a battery, an ignition switch, an oil sump, an engine pump outlet, a lubricating oil, a normally provided engine oil filter, a normally provided oil filter threaded point of connection, an engine oil gallery, said apparatus comprising:

an assembly case, said assembly case being cylindrical in shape and open at one end, said assembly case dimensioned to replace the normally supplied oil filter which is generally cylindrical in shape, said assembly case provided with a threaded section in the inside periphery next to said open end;

an assembly adapter circular in shape and dimensioned to be the complement to said assembly case in forming a cylinder, said assembly adapter provided with a threaded section around its outside periphery for matching the threads provided in said assembly case;

a pump assembly formed by mating said assembly adapter to said assembly case by threading their mating threads into each other;

an electric pump enclosed by said pump assembly and having its outlet fluidly connected to an outlet chamber fluidly connected to an internal volume defined by said pump assembly;

a first check valve in series with said pump outlet;

an inlet of said electric pump connected to a conduit means connected to a modified drain plug having a center channel to allow flow and access to said lubricating oil contained in said oil sump;

a second check valve in series with said pump inlet;

a transverse oil filter cartridge shaped like a hockey puck whose function is to filter the normal operating flow of lubricating oil while said engine is operating, said transverse oil filter cartridge sandwiched between said assembly case and said assembly adapter, said oil filter cartridge fluidly interposed between the volume defined by the pump assembly and the hydraulic access point to the engine lubricating gallery;

a female thread centrally provided in said assembly adapter to facilitate connection to said normally provided oil filter threaded point of connection;

a rubber gasket circular in shape and rectangular in its cross section sandwiched between said assembly adapter and the normally provided oil filter attachment point on the engine block;

a plurality of orifices arranged in a circular pattern around said female thread of said assembly adapter to allow for fluidly connecting the outlet of the normally provided engine oil pump to the engine lubricating gallery through said transverse oil filter cartridge; and a programmable logic control means coupled to said electric pump for automatically switching control power from said battery according to an operating cycle and operatively independent of said ignition switch state.

* * * * *